US012222151B2

(12) United States Patent
Long et al.

(10) Patent No.: US 12,222,151 B2
(45) Date of Patent: Feb. 11, 2025

(54) REFRIGERATOR AND ICE MAKING METHOD THEREOF

(71) Applicant: HISENSE RONSHEN (GUANGDONG) REFRIGERATOR CO., LTD., Guangdong (CN)

(72) Inventors: Xiaofen Long, Foshan (CN); Huimin Yao, Foshan (CN); Yuhua Guo, Foshan (CN); Yubo Lu, Foshan (CN)

(73) Assignee: HISENSE RONSHEN (GUANGDONG) REFRIGERATOR CO., LTD., Guangdong (CN)

( * ) Notice: Subject to any disclaimer, the term of this patent is extended or adjusted under 35 U.S.C. 154(b) by 0 days.

(21) Appl. No.: 17/792,035

(22) PCT Filed: Nov. 15, 2021

(86) PCT No.: PCT/CN2021/130754
§ 371 (c)(1),
(2) Date: Jul. 11, 2022

(87) PCT Pub. No.: WO2022/262185
PCT Pub. Date: Dec. 22, 2022

(65) Prior Publication Data

US 2024/0068730 A1 Feb. 29, 2024

(30) Foreign Application Priority Data

Jun. 15, 2021 (CN) ..... 202110658712.2

(51) Int. Cl.
*F25C 5/20* (2018.01)
*F25C 1/25* (2018.01)

(52) U.S. Cl.
CPC ..... *F25C 5/22* (2018.01); *F25C 1/25* (2018.01); *F25C 2400/10* (2013.01); *F25C 2600/04* (2013.01); *F25C 2700/02* (2013.01)

(58) Field of Classification Search
CPC .... F25C 5/22; F25C 2400/10; F25C 2600/04; F25C 2700/02
See application file for complete search history.

(56) References Cited

U.S. PATENT DOCUMENTS

2010/0050681 A1 3/2010 Ryu et al.
2012/0111031 A1 5/2012 Lee
(Continued)

FOREIGN PATENT DOCUMENTS

CN 104075533 A 10/2014
CN 205860591 U 1/2017
(Continued)

OTHER PUBLICATIONS

International Search Report and Written Opinion issued in corresponding International Patent Application No. PCT/CN2021/130754 dated Feb. 23, 2022, with English translation.
(Continued)

*Primary Examiner* — Elizabeth J Martin
(74) *Attorney, Agent, or Firm* — Morgan, Lewis & Bockius LLP

(57) ABSTRACT

A refrigerator is provided and includes a refrigerator body, a door body, an ice making apparatus and a controller. The refrigerator body includes a storage compartment. The door body is pivotally connected to the refrigerator body to open or close the storage compartment. The ice making apparatus includes a plurality of ice makers. The controller is configured to control at least one of the plurality of ice makers to make ice according to an ice making request.

18 Claims, 4 Drawing Sheets

(56) References Cited

U.S. PATENT DOCUMENTS

| | | | | |
|---|---|---|---|---|
| 2012/0111048 | A1* | 5/2012 | Kim | F25C 1/10 62/340 |
| 2013/0327068 | A1 | 12/2013 | Lee | |
| 2023/0243565 | A1* | 8/2023 | Kim | F25C 1/04 62/139 |

FOREIGN PATENT DOCUMENTS

| | | | |
|---|---|---|---|
| CN | 106642955 | A | 5/2017 |
| CN | 112066611 | A | 12/2020 |
| EP | 3 967 954 | A1 | 3/2022 |
| WO | 2020/224188 | A1 | 11/2020 |

OTHER PUBLICATIONS

Chinese Office Action dated Apr. 8, 2023, issued in corresponding Chinese Patent Application No. 202110658712.2.

* cited by examiner

REFRIGERATOR AND ICE MAKING METHOD THEREOF

CROSS-REFERENCE TO RELATED APPLICATIONS

This application is a national phase entry under 35 USC 371 of International Patent Application No. PCT/CN2021/130754 filed on Nov. 15, 2021, which claims priority to Chinese Patent Application No. 202110658712.2, filed on Jun. 15, 2021, which are incorporated herein by reference in their entireties.

TECHNICAL FIELD

The present disclosure relates to the technical field of household appliances, and in particular, to a refrigerator and an ice making method of a refrigerator.

BACKGROUND

With the increasing demand from consumers for functions of refrigerators, refrigerators with an ice making function are becoming more and more popular with the consumers.

A main component in the refrigerator to achieve the ice making function is an ice maker, and the ice maker is generally disposed in an ice making compartment separated from a refrigerating compartment or a freezing compartment. A basic principle of ice making includes: injecting water into an ice tray in the ice maker, then supplying cold to the ice making compartment to make the water in the ice tray freeze into an ice cube, and finally demolding the ice cube from the ice tray and transporting the ice cube into an ice storage box for access by a user.

SUMMARY

In an aspect, a refrigerator is provided. The refrigerator includes a refrigerator body, a door body, an ice making apparatus and a controller. The refrigerator body includes a storage compartment. The door body is pivotally connected to the refrigerator body, so as to open or close the storage compartment. The ice making apparatus includes a plurality of ice makers. The controller is configured to control at least one of the plurality of ice makers to make ice according to an ice making request. In some embodiments, the plurality of ice makers include a first ice maker and a second ice maker, and the ice making request includes an ice making request for the first ice maker and the second ice maker, an ice making request for the first ice maker or an ice making request for the second ice maker. The ice making request for the first ice maker and the second ice maker to cause the controller to turn on the first ice maker and the second ice maker. The ice making request for the first ice maker to cause the controller to turn on the first ice maker and turn off the second ice maker. The ice making request for the second ice maker to cause the controller to turn off the first ice maker and turn on the second ice maker.

In another aspect, an ice making method of a refrigerator is provided. The refrigerator includes an ice making apparatus and a controller. The ice making apparatus includes a plurality of ice makers. The ice making method of the refrigerator includes; obtaining an ice making request; and controlling at least one of the plurality of ice makers to make ice according to the ice making request. In some embodiments, the plurality of ice makers include a first ice maker and a second ice maker, and the ice making request includes an ice making request for the first ice maker and the second ice maker, an ice making request for the first ice maker or an ice making request for the second ice maker. The ice making request for the first ice maker and the second ice maker to cause the controller to turn on the first ice maker and the second ice maker. The ice making request for the first ice maker to cause the controller to turn on the first ice maker and turn off the second ice maker. The ice making request for the second ice maker to cause the controller to turn off the first ice maker and turn on the second ice maker.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings in the following description may be regarded as schematic diagrams, but are not limitations on actual sizes of products, actual processes of methods and actual timings of signals to which the embodiments of the present disclosure relate.

DETAILED DESCRIPTION

Figure 1:
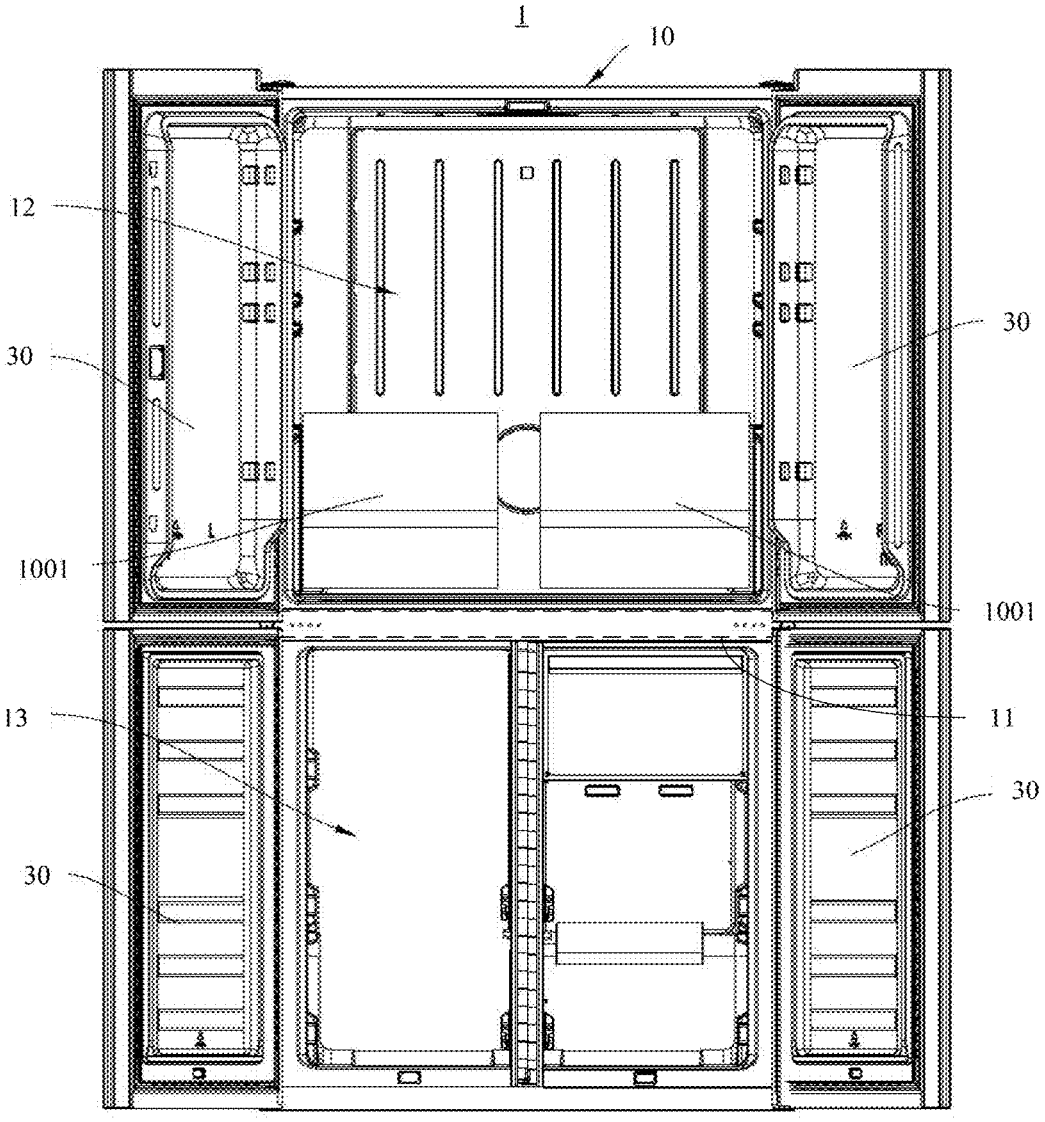
FIG. 1 is a diagram showing a structure of a refrigerator with a door body thereof in an open state, in accordance with some embodiments.

Technical solutions in some embodiments of the present disclosure will be described clearly and completely below with reference to the accompanying drawings. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the specification and the claims, the term "comprise" and other forms thereof such as the third-person singular form "comprises" and the present participle form "comprising" are construed as being open and inclusive, meaning "including, but not limited to". In the description, the terms such as "one embodiment", "some embodiments", "exemplary embodiments", "an example", "a specific example" or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics described herein may be included in any one or more embodiments or examples in any suitable manner.

Hereinafter, the terms "first" and "second" are only used for descriptive purposes, and cannot be construed as indicating or implying the relative importance or implicitly indicating the number of indicated technical features. Thus, features defined with "first" and "second" may explicitly or implicitly include one or more of the features. In the description of the embodiments of the present disclosure, the term "a plurality of" or "the plurality of" means two or more unless otherwise specified.

In the description of some embodiments, the term "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The phrase "A and/or B" includes the following three combinations: only A, only B, and a combination of A and B.

As used herein, the term "if" is optionally interpreted to mean "when" or "in a case where" or "in response to determining that" or "in response to detecting" depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]".

The use of the phrase "applicable to" or "configured to" herein means an open and inclusive language, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or value exceeding those stated.

As used herein, terms such as "about", "substantially" or "approximately" includes a stated value and an average value within an acceptable range of deviation of a particular value. The acceptable range of deviation is determined by a person of ordinary skill in the art, in consideration of the measurement in questions and errors associated with the measurement of a particular quantity (i.e., the limitations of a measurement system).

A side of a refrigerator 1 facing a user during use is defined as a front side, and a side opposite to the front side is defined as a rear side.

Figure 2:
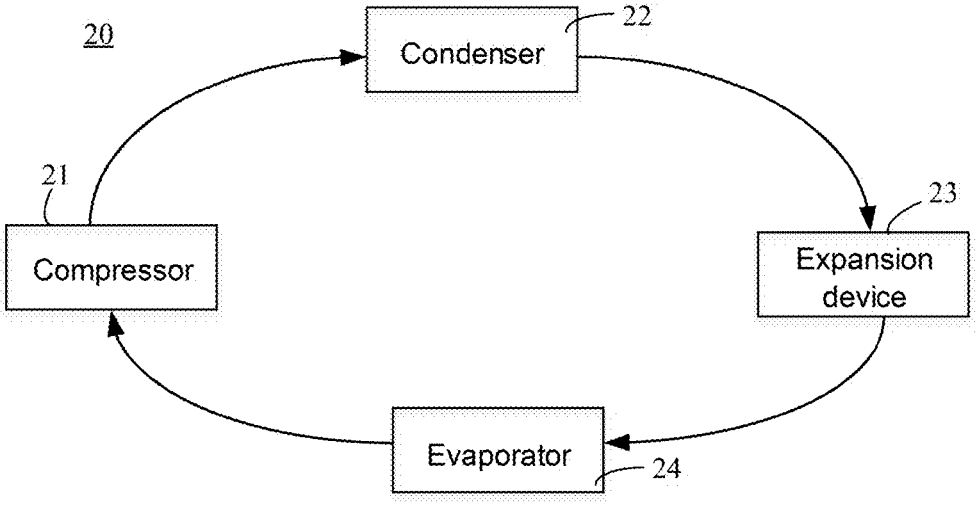
FIG. 2 is a schematic diagram of a cold air supply device of a refrigerator, in accordance with some embodiments.

In some embodiments, referring to FIGS. 1 and 2, the refrigerator 1 includes a refrigerator body 10, a cold air supply device 20 and a door body 30. The refrigerator body 10 includes a storage compartment, the cold air supply device 20 is configured to cool the storage compartment. The door body 30 is configured to open and close the storage compartment.

The cold air supply device 20 cools the storage compartment by performing heat exchange with an outside of the refrigerator body 10, As shown in FIG. 2, the cold air supply device 20 includes a compressor 21, a condenser 22, an expansion device 23 and an evaporator 24, and refrigerant circulates in a sequence of the compressor 21, the condenser 22, the expansion device 23, the evaporator 24 and the compressor 21 to cool the storage compartment.

For example, the evaporator 24 may be arranged to be in contact with an outer wall of the storage compartment, so as to directly cool the storage compartment. In some embodiments, the cold air supply device 20 may further include a circulation fan, so that air in the storage compartment may be circulated through the evaporator 24 and the circulation fan.

The refrigerator body 10 includes a horizontal partition plate 11 disposed at a middle position of the refrigerator body 10 in a height direction, and the horizontal partition plate 11 extends in a left-right direction in FIG. 1. A substantial position of the horizontal partition plate 11 is shown with reference to the dotted frame in FIG. 1, and the height direction is shown with reference to an upper-lower direction in FIG. 1. The storage compartment is partitioned into an upper storage compartment 12 and a lower storage compartment 13 by the horizontal partition plate 11.

In some embodiments, the upper storage compartment 12 is served as a freezing compartment for storing foods in a freezing mode, and the lower storage compartment 13 is served as a refrigerating compartment for storing foods in a refrigerating mode.

In addition, the refrigerator 1 may further include an ice maker 1001, so that the refrigerator 1 has an ice making function. Ice cubes or ice water may be provided to the user through the ice maker 1001.

In some embodiments, the ice maker 1001 is directly disposed in the freezing compartment. In this case, the freezing compartment is the ice making compartment. FIG. 1 shows an example in which the ice maker 1001 is disposed in the upper storage compartment 12 (i.e., the freezing compartment). Alternatively, an independent ice making compartment is defined by a heat insulating plate in the refrigerating compartment or the freezing compartment, and the ice maker 1001 is disposed in the ice making compartment.

The door body 30 is pivotally connected to the refrigerator body 10, so as to open or close the storage compartment. For example, the door body 30 may be hinged to a front end of the refrigerator body 10. Four door bodies 30 are shown in FIG. 1.

In some embodiments, the refrigerator 1 includes one ice maker 1001, and the one ice maker 1001 corresponds to one waterway for ice making. In some embodiments, the refrigerator 1 includes two ice makers 1001, three ice makers 1001 or more ice makers 1001, and the waterways for ice making are in one-to-one correspondence with the ice makers 1001. For ease of description, some embodiments of the present disclosure are mainly described by taking an example in which the refrigerator 1 includes two ice makers 1001. However, this should not be construed as a limitation on the present disclosure.

Figure 3:
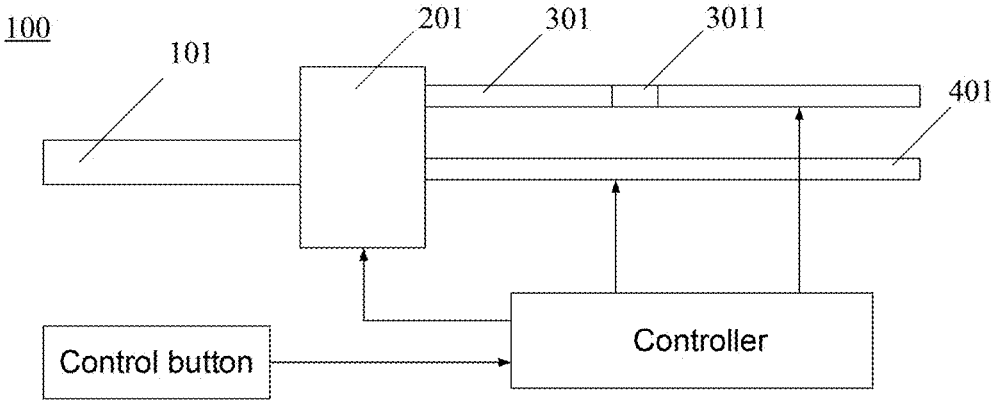
FIG. 3 is a diagram showing a structure of an ice making apparatus of a refrigerator, in accordance with some embodiments.

As shown in FIG. 3, the refrigerator 1 further includes an ice making apparatus 100. In some embodiments, the ice making apparatus 100 includes a water inlet pipe 101, a water valve 201, a first ice maker 301, a second ice maker 401 and a flow meter 3011. An end of the water valve 201 is connected to the water inlet pipe 101, and another end of the water valve 201 is connected to the first ice maker 301 and the second ice maker 401.

For example, the water inlet pipe 101 may be served as a water inlet of the water valve 201, and it is convenient for an external water source to supply water to the first ice maker 301 and the second ice maker 401 through the water inlet pipe 101 and the water valve 201. The first ice maker 301 and the second ice maker 401 are configured to make water flowing out from the water valve 201 into ice. At least one of the first ice maker 301 or the second ice maker 401 includes the flow meter 3011.

In some embodiments, the refrigerator 1 further includes a controller, and the controller is configured to obtain an ice making request of a user. The ice making request includes an ice making request for dual ice makers (i.e., the first ice maker 301 and the second ice maker 401), an ice making request for the first ice maker 301 or an ice making request for the second ice maker 401. In a case where the ice making request is the ice making request for dual ice makers, the first ice maker 301 and the second ice maker 401 are turned on. In a case where the ice making request is the ice making request for the first ice maker 301, the first ice maker 301 is turned on and the second ice maker 401 is turned off. In a case where the ice making request is the ice making request for the second ice maker 401, the first ice maker 301 is turned off and the second ice maker 401 is turned on.

In some embodiments, the refrigerator 1 further includes a control button, and the ice making request includes triggering the control button of the refrigerator 1. For example, in a case where the user needs the refrigerator 1 to make preset amount of ice cubes, the user may send the ice making request for dual ice makers or the ice making request for the first ice maker 301. During this process, the refrigerator 1 may make ice according to an ice making amount set by the user. In a case where there is no need for the user to set the amount of ice cubes made by the refrigerator 1, the user may send the ice making request for the second ice maker 401, and the refrigerator 1 may make ice directly.

It will be noted that, in a case where the user sends the ice making request for dual ice makers, a distribution ratio of an ice making water amount of the first ice maker 301 to an ice making water amount of the second ice maker 401 may be preset. For example, the user may set the distribution ratio of the ice making water amount of the first ice maker 301 to the ice making water amount of the second ice maker 401 through the control button. The distribution ratio of the ice making water amount of the first ice maker 301 to the ice making water amount of the second ice maker 401 includes 1:1 or 2:3.

In some embodiments, the user presets the ice making amount of the refrigerator 1, and the distribution ratio of the ice making water amount of the first ice maker 301 to the ice making water amount of the second ice maker 401 is also preset. Therefore, in a case where the ice making amount is determined, the ice making water amount of the first ice maker 301 distributed by the water valve 201 and the ice making water amount of the second ice maker 401 distributed by the water valve 201 may be determined.

In a case where both the first ice maker 301 and the second ice maker 401 are turned on, the refrigerator 1 determines a first water injection amount distributed to the first ice maker 301 and a second water injection amount distributed to the second ice maker 401 according to the preset distribution ratio (e.g., 1:1 or 2:3). In a case where only the first ice maker 301 is turned on, the first water injection amount is equal to an ice making water amount corresponding to the ice making amount. In a case where only the second ice maker 401 is turned on, the second water injection amount is equal to the ice making water amount corresponding to the ice making amount.

Herein, the first water injection amount is equal to the ice making water amount of the first ice maker 301 distributed by the water valve 201, and the second water injection amount is equal to the ice making water amount of the second ice maker 401 distributed by the water valve 201.

For example, in a case where the distribution ratio of the ice making water amount of the first ice maker 301 to the ice making water amount of the second ice maker 401 is 1:1, and both the first ice maker 301 and the second ice maker 401 are turned on, the first water injection amount and the second water injection amount are equal to half of the ice making water amount corresponding to the ice making amount. That is to say, the distribution ratio of the first water injection amount to the second water injection amount is 1:1.

For another example, in a case where the distribution ratio of the ice making water amount of the first ice maker 301 to the ice making water amount of the second ice maker 401 is 2:3, and both the first ice maker 301 and the second ice maker 401 are turned on, the first water injection amount is equal to two-fifths of the ice making water amount corresponding to the ice making amount, and the second water injection amount is equal to three-fifths of the ice making water amount corresponding to the ice making amount. That is to say, the distribution ratio of the first water injection amount to the second water injection amount is 2:3.

Figure 6:
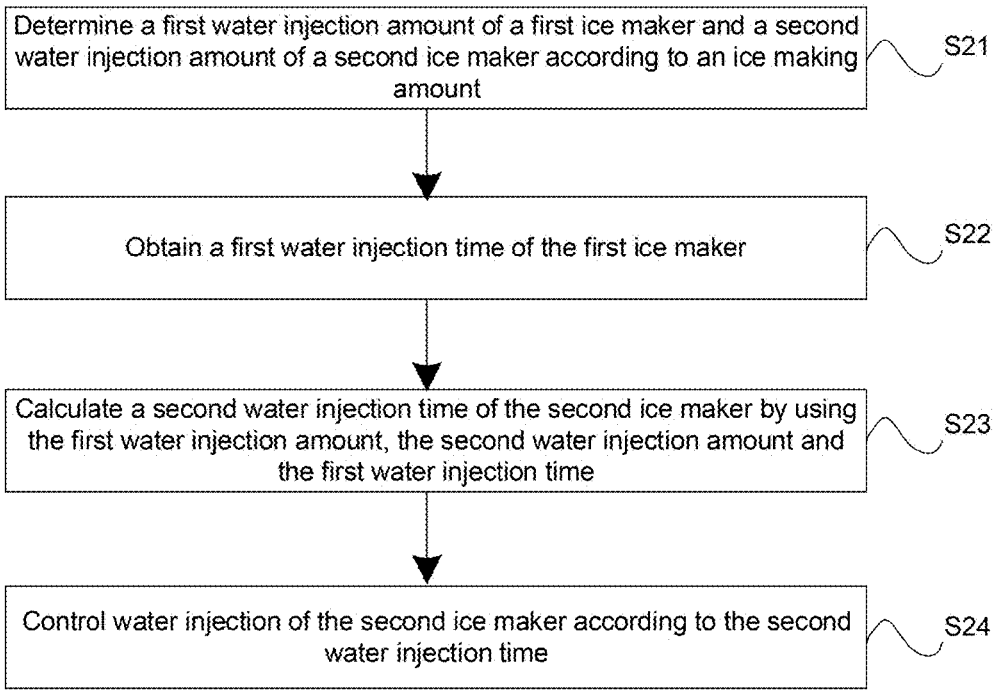
FIG. 6 is another flow diagram of an ice making method of a refrigerator, in accordance with some embodiments.

In some embodiments, as shown in FIG. 6, in a case where both the first ice maker 301 and the second ice maker 401 are turned on, the controller is further configured to determine the first water injection amount of the first ice maker 301 and the second water injection amount of the second ice maker 401 according to the ice making amount; obtain a first water injection time of the first ice maker 301; calculate a second water injection time of the second ice maker 401 based on the first water injection amount, the second water injection amount and the first water injection time; control water injection of the second ice maker 401 according to the second water injection time.

For example, in a case where both the first ice maker 301 and the second ice maker 401 are required to make ice, the first water injection amount of the first ice maker 301 and the second water injection amount of the second ice maker 401 are distributed according to the ice making amount. First, it is necessary to control the first ice maker 301 to start a water injection program, and to control the first ice maker 301 to stop the water injection program until a number of pulses of the flow meter 3011 in real time reach a preset pulse threshold. Then, it is possible to obtain the first water injection time of the first ice maker 301 from a start of the water injection program to a stop of the water injection program. The first water injection time is the water injection time of the first ice maker 301.

It will be noted that, the flow meter 3011 will generate a pulse every time a certain amount of water passes through the flow meter 3011 within a certain water pressure range, and a total number of pulses generated indicates how much water amount has passed. It is possible to calculate the water injection time when the water amount reaches the first water injection amount according to the number of pulses. For example, in order to achieve the first water injection amount of 500 g, it is necessary for the number of pulses of the flow meter 3011 to reach 500, if one pulse indicates 1 g of water. In this case, the pulse threshold may be set as 500. When the number of pulses of the flow meter 3011 in real time reaches 500, it indicates that 500 g water has been injected, and the corresponding first water injection amount may also reach 500 g. In this case, it is necessary to stop the water injection program of the first ice maker 301.

After the first water injection time is obtained, calculating the second water injection time of the second ice maker 401 based on the first water injection amount, the second water injection amount and the first water injection time. Finally, it is possible to control water injection of the second ice maker 401 according to the second water injection time. After completing a round of water injection, the refrigerator 1 will retain the calculated flow velocity parameters of the first ice maker 301 and the second ice maker 401. Therefore, during a next ice making process, the second water injection time of the second ice maker 401 does not need to be calculated by the first ice maker 301 working first. For example, an ice making sequence between the first ice maker 301 and the second ice maker 401 may no longer have priority restrictions. In a case where the first ice maker 301 or the second ice maker 401 has a water injection demand, the controller determines whether water is currently being injected. If the water is being injected, the controller waits for the completion of water injection, and then controls the first ice maker 301 and the second ice maker 401 to work according to a new water injection demand. If the water is not being injected, the controller controls the first ice maker 301 and the second ice maker 401 to work according to the new water injection demand.

For example, the description that calculating the second water injection time of the second ice maker 401 based on the first water injection amount, the second water injection amount and the first water injection time satisfies the following formula.

$$ticeB=V2\times ticeA/V1.$$

Herein, ticeB is the second water injection time, V1 is the first water injection amount, V2 is the second water injection amount, and ticeA is the first water injection time.

In some embodiments, the models of the first ice maker 301 and the second ice maker 401 may be the same or different. Despite that the models of the first ice maker 301 and the second ice maker 401 are different, water pressures of the waterways are substantially the same, and diameters of connecting pipes used by the first ice maker 301 and the second ice maker 401 are substantially the same. Therefore, the flow velocity of the first ice maker 301 and that of the second ice maker 401 are substantially the same, so as to calculate the second water injection time required for the second ice maker 401 to complete the second water injection amount according to the first water injection amount and the first water injection time of the first ice maker 301.

In a case where the refrigerator 1 only includes one ice maker 1001 (e.g., the first ice maker 301 or the second ice maker 401), the amount of ice cubes that can be made is limited, and the ice making demand may not be satisfied for the user who has a demand for a large ice making amount. In addition, in a case where there is a large demand for ice making, a single ice maker 1001 is likely to be damaged if the ice maker 1001 is in a working state for a long time.

In some embodiments, the refrigerator 1 includes two ice makers 1001, that is, the first ice maker 301 and the second ice maker 401. By controlling both the first ice maker 301 and the second ice maker 401 to make ice, it is not only beneficial to increase the ice making amount, but also to prolong the service life of the ice maker 1001.

In some embodiments, in a case where the ice making request is the ice making request for the second ice maker 401, it indicates that the user wants the refrigerator 1 to start making ice, but the user has no requirement for the ice making amount. In this case, the first ice maker 301 is turned off and the second ice maker 401 is turned on, and the second ice maker 401 shown in FIGS. 3 and 4 does not include the flow meter. Therefore, in a case where only the second ice maker 401 is turned on, there is no need to accurately calculate the ice making amount, and the user's ice making demand with no predetermined amount may be satisfied, and the cost is low.

Of course, in some embodiments, the second ice maker 401 may also include the flow meter without considering the costs.

Figure 4:
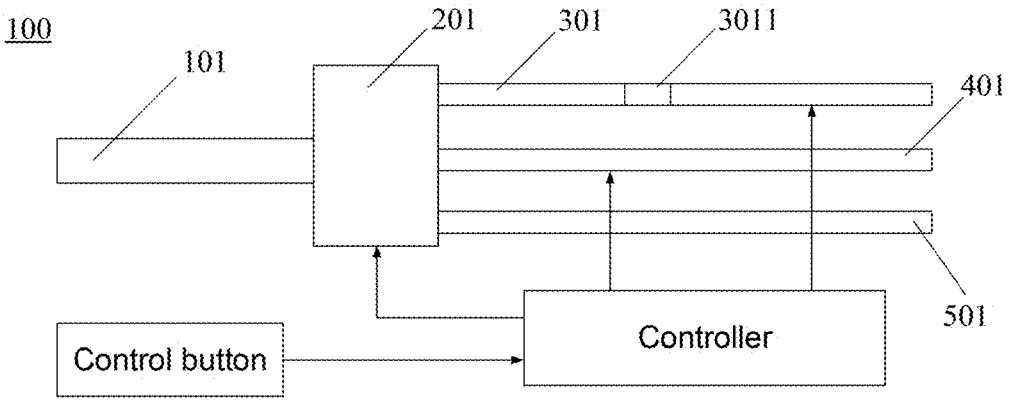
FIG. 4 is a diagram showing a structure of another ice making apparatus of a refrigerator, in accordance with some embodiments.

In some embodiments, as shown in FIG. 4, the ice making apparatus 100 further includes a water outlet pipe 501 connected to the water valve 201. For example, the water outlet pipe 501 is connected to the another end of the water valve 201, and the water outlet pipe 501 is configured to convey part of the water entering the water valve 201 through the water inlet pipe 101 to a water dispenser, so that the user may take water.

For example, the water valve 201 may include one water inlet and three water outlets. Water from the external water source enters the water valve 201 from the water inlet of the water inlet pipe 101. Then, the water enters the first ice maker 301 through one water outlet, enters the second ice maker 401 through another water outlet, and enters the water outlet pipe 501 through yet another water outlet. The water outlet pipe 501 is configured to be connected to the water dispenser, so that the user may take water on demand.

Figure 7:
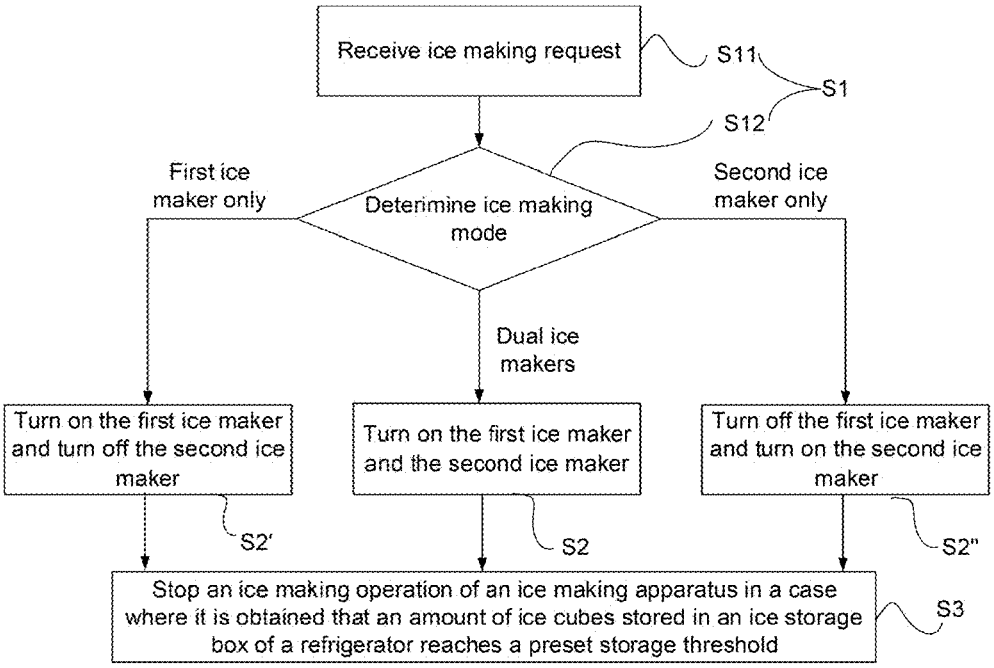
FIG. 7 is yet another flow diagram of an ice making method of a refrigerator, in accordance with some embodiments.

In some embodiments, the refrigerator 1 further includes an ice storage box to store ice cubes. As shown in FIG. 7, the controller is further configured to stop an ice making operation of the ice making apparatus 100 when the controller obtains that an amount of ice cubes stored in the ice storage box of the refrigerator 1 reaches a preset storage threshold.

For example, the ice storage box of the refrigerator 1 detects the amount of ice cubes stored in the ice storage box in real time. When the amount of ice cubes reaches the storage threshold, it indicates that the ice cubes stored in the ice storage box has satisfied the requirement, and there is no need to continue making ice. As a result, it is necessary to stop the ice making operations of the first ice maker 301 and the second ice maker 401.

The refrigerator 1 in some embodiments of the present disclosure includes the first ice maker 301 and the second ice maker 401, so that the refrigerator 1 may selectively start at least one of the first ice maker 301 or the second ice maker 401 according to the ice making request of the user. As a result, not only the ice making amount may be increased, but also different ice making requirements of the users may be satisfied.

In addition, in a case where the first ice maker 301 includes the flow meter 3011, and the second ice maker 401 does not include the flow meter 3011, it is possible to meet the diversified ice making requirements of the users, and save the costs.

Figure 5:
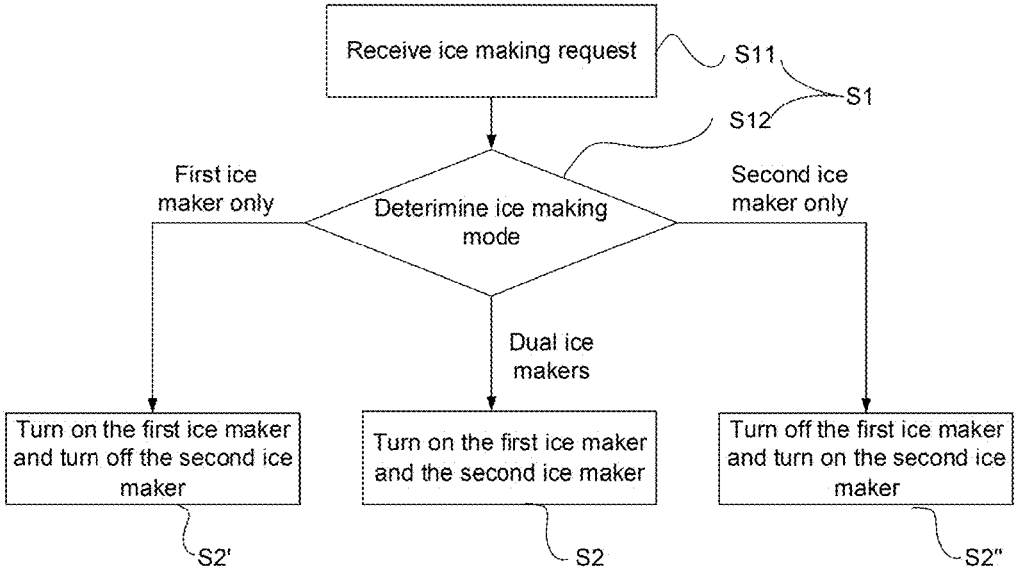
FIG. 5 is a flow diagram of an ice making method of a refrigerator, in accordance with some embodiments.

As shown in FIG. 5, in some embodiments of the present disclosure, an ice making method of a refrigerator is also provided. The refrigerator includes the ice making apparatus 100, and the ice making apparatus 100 includes a water inlet pipe 101, a water valve 201, a first ice maker 301, a second ice maker 401 and a flow meter 3011. The ice making method of the refrigerator includes step 1 to step 2" (S1 to S2").

In S1, an ice making request of a user is obtained. The ice making request includes an ice making request for dual ice makers (i.e., the first ice maker 301 and the second ice maker 401), an ice making request for the first ice maker 301 or an ice making request for the second ice maker 401. That the ice making request of the user is obtained includes S11 and S12. In S11, an ice making request is received; In S12, an ice making mode is determined.

In S2, the first ice maker 301 and the second ice maker 401 are turned on in a case where the ice making request is the ice making request for dual ice makers.

In S2', the first ice maker 301 is turned on and the second ice maker 401 is turned off in a case where the ice making request is the ice making request for the first ice maker 301.

In S2", the first ice maker 301 is turned off and the second ice maker 401 is turned on in a case where the ice making request is the ice making request for the second ice maker 401.

In some embodiments, the refrigerator 1 further includes a control button, and the ice making request includes triggering the control button of the refrigerator 1. For example, in a case where the user needs the refrigerator 1 to make preset amount of ice cubes, the user may send the ice making request for dual ice makers or the ice making request for the first ice maker 301. During this process, the refrigerator 1 may make ice according to the ice making amount set by the user. In a case where there is no need for the user to set the amount of the ice cubes made by the refrigerator 1, the user may send the ice making request for the second ice maker 401, and the refrigerator 1 may make ice directly.

It will be noted that, in a case where the user sends the ice making request for dual ice makers, a distribution ratio of an ice making water amount of the first ice maker 301 to an ice making water amount of the second ice maker 401 may be preset. For example, the user may set the distribution ratio of the ice making water amount of the first ice maker 301 to the water amount of the ice making second ice maker 401 through the control button. The distribution ratio of the ice making water amount of the first ice maker 301 to the ice making water amount of the second ice maker 401 includes 1:1 or 2:3.

In some embodiments, the user (or the manufacturer) presets the ice making amount of the refrigerator 1, and the distribution ratio of the ice making water amount of the first ice maker 301 to the ice making water amount of the second ice maker 401 is also preset. Therefore, in a case where the ice making amount is determined, the ice making water amount of the first ice maker 301 distributed by the water valve 201 and the ice making water amount of the second ice maker 401 distributed by the water valve 201 may be determined. In a case where both the first ice maker 301 and the second ice maker 401 are turned on, the refrigerator 1 determines a first water injection amount distributed to the first ice maker 301 and a second water injection amount distributed to the second ice maker 401 according to the preset distribution ratio (e.g., 1:1 or 2:3). In a case where only the first ice maker 301 is turned on, the first water injection amount is equal to an ice making water amount corresponding to the ice making amount. In a case where only the second ice maker 401 is turned on, the second water injection amount is equal to the ice making water amount corresponding to the ice making amount.

In some embodiments, as shown in FIG. 6, in a case where both the first ice maker 301 and the second ice maker 401 are turned on, the step 2 (S2) further includes step 21 to step 24 (S21 to S24).

In S21, the first water injection amount of the first ice maker 301 and the second water injection amount of the second ice maker 401 are determined according to the ice making amount.

In S22, a first water injection time of the first ice maker 301 is obtained.

In S23, a second water injection time of the second ice maker 401 is calculated based on the first water injection amount, the second water injection amount and the first water injection time.

In S24, the water injection of the second ice maker 401 is controlled according to the second water injection time.

For example, in a case where both the first ice maker 301 and the second ice maker 401 are required to make ice, the first water injection amount of the first ice maker 301 and the second water injection amount of the second ice maker 401 are distributed according to the ice making amount. First, it is necessary to control the first ice maker 301 to start a water injection program, and to control the first ice maker 301 to stop the water injection program until the number of pulses of the flow meter 3011 in real time reaches a preset pulse threshold. Then, it is possible to obtain the first water injection time of the first ice maker 301 from the start of the water injection program to the stop of the water injection program. The first water injection time is the water injection time of the first ice maker 301.

It will be noted that, the flow meter 3011 will generate a pulse every time a certain amount of water passes through the flow meter 3011 within a certain water pressure range, and a total number of pulses generated indicates how much water amount has passed. It is possible to calculate the water injection time when the water amount reaches the first water injection amount according to the number of pulses. For example, in order to achieve the first water injection amount of 500 g, it is necessary for the number of pulses of the flow meter 3011 to reach 500, if one pulse indicates 1 g of water. In this case, the pulse threshold may be set as 500. When the number of pulses of the flow meter 3011 in real time reaches 500, it indicates that 500 g water has been injected, and the corresponding first water injection amount may also reach 500 g. In this case, it is necessary to stop the water injection program of the first ice maker 301.

After the first water injection time is obtained, calculating the second water injection time of the second ice maker 401 based on the first water injection amount, the second water injection amount and the first water injection time. Finally, it is possible to control water injection of the second ice maker 401 according to the second water injection time. After completing a round of water injection, the refrigerator 1 will retain the calculated flow velocity parameters of the first ice maker 301 and the second ice maker 401. Therefore, during the next ice making process, the second water injection time of the second ice maker 401 does not need to be calculated by the first ice maker 301 working first. For example, an ice making sequence between the first ice maker 301 and the second ice maker 401 may no longer have priority restrictions. In a case where the first ice maker 301 or the second ice maker 401 has a demand for water injection, the controller determines whether water is currently being injected. If the water is being injected, the controller waits for the completion of water injection, and then controls the first ice maker 301 and the second ice maker 401 to work according to a new water injection demand. If the water is not being injected, the controller controls the first ice maker 301 and the second ice maker 401 to work according to the new water injection demand.

For example, the description that calculating the second water injection time of the second ice maker 401 based on the first water injection amount, the second water injection amount and the first water injection time satisfies the following formula.

$$ticeB=V2\times ticeA/V1.$$

Herein, ticeB is the second water injection time, V1 is the first water injection amount, V2 is the second water injection amount, and ticeA is the first water injection time.

In some embodiments, the models of the first ice maker 301 and the second ice maker 401 may be the same or different. Despite that the models of the first ice maker 301 and the second ice maker 401 are different, water pressures of the waterways are substantially the same, and diameters of connecting pipes used by the first ice maker 301 and the second ice maker 401 are substantially the same. Therefore, the flow velocity of the first ice maker 301 and that of the second ice maker 401 are substantially the same, so as to calculate the second water injection time required for the second ice maker 401 to complete the second water injection amount according to the first water injection amount and the first water injection time of the first ice maker 301.

In a case where the refrigerator 1 only includes one ice maker (e.g., the first ice maker 301 or the second ice maker 401), the amount of ice cubes that may be made is limited, and the ice making demand may not be satisfied for the user who has a demand for a large ice making amount. In addition, in a case where there is a large demand for ice making, a single ice maker is likely to be damaged if the ice maker is in a working state for a long time.

In some embodiments, the refrigerator 1 includes two ice makers, that is, the first ice maker 301 and the second ice maker 401. By controlling both the first ice maker 301 and the second ice maker 401 to make ice, it is not only beneficial to increase the ice making amount, but also to prolong the service life of the ice maker.

In some embodiments, in a case where the ice making request is the ice making request for the second ice maker 401, it indicates that the user wants the refrigerator 1 to start making ice, but the user has no requirement for the ice making amount. In this case, the first ice maker 301 is turned off and the second ice maker 401 is turned on, and the second ice maker 401 shown in FIGS. 3 and 4 does not include the flow meter. Therefore, in a case where only the second ice maker 401 is turned on, there is no need to accurately calculate the ice making amount, and the user's ice making demand with no predetermined amount may be satisfied.

Of course, in some embodiments, the second ice maker 401 may also include the flow meter without considering the costs.

In some embodiments, the refrigerator 1 further includes an ice storage box to store ice cubes. As shown in FIG. 4, the ice making apparatus 100 further includes a water outlet pipe 501, and the water outlet pipe 501 is configured to convey part of the water entering the water valve 201 through the water inlet pipe 101 to a water dispenser, so that the user may take water.

As shown in FIG. 7, the ice making method of the refrigerator further includes step 3 (S3).

In S3, an ice making operation of the ice making apparatus 100 is stopped when the controller obtains that an amount of ice cubes stored in the ice storage box of the refrigerator 1 reaches a preset storage threshold.

For example, the ice storage box of the refrigerator 1 detects the amount of ice cubes stored in the ice storage box in real time. When the amount of ice cubes reaches the storage threshold, it indicates that the amount of ice cubes stored in the ice storage box has satisfied the requirement, and there is no need to continue making ice. As a result, it is necessary to stop the ice making operations of the first ice maker 301 and the second ice maker 401.

In one example, the controller may include a processor and a non-transitory computer-readable recording medium storing computer readable code or software. When the processor reads and executes the computer readable code or software, the processor is configured to perform the respective operations describe with reference to the controller.

The foregoing descriptions are merely specific implementation manners of the present disclosure, but the protection scope of the present disclosure is not limited thereto. Any person skilled in the art could conceive of changes or replacements within the technical scope of the present disclosure, which shall be included in the protection scope of the present disclosure. Therefore, the protection scope of the present disclosure shall be subject to the protection scope of the claims.

A person skilled in the art will understand that, the scope of disclosure involved in the present disclosure is not limited to technical solutions formed by specific combinations of the above technical features, and shall cover other technical solutions formed by any combination of the above technical features or their equivalent features without departing from the concept of disclosure. For example, technical solutions formed by replacing the above features with technical features with similar functions disclosed in some embodiments (but not limited thereto).

What is claimed is:

1. A refrigerator, comprising:

a refrigerator body including a storage compartment;

a door body pivotally connected with the refrigerator body to open or close the storage compartment;

an ice making apparatus including a plurality of ice makers; and a controller configured to control at least one of the plurality of ice makers to make ice according to an ice making request; wherein the plurality of ice makers include a first ice maker and a second ice maker, and the ice making request includes:

an ice making request for the first ice maker and the second ice maker to cause the controller to turn on the first ice maker and the second ice maker; and after the first ice maker and the second ice maker are turned on, the controller is further configured to:

determine a first water injection amount of the first ice maker and a second water injection amount of the second ice maker according to a preset ice making amount;

obtain a first water injection time of the first ice maker;

calculate a second water injection time of the second ice maker based on the first water injection amount, the second water injection amount and the first water injection time; and control water injection of the second ice maker according to the second water injection time.

2. The refrigerator according to claim 1, wherein the ice making apparatus further includes a flow meter, and at least one of the plurality of ice makers includes the flow meter.

3. The refrigerator according to claim 2, wherein
the first ice maker includes the flow meter, and the second ice maker does not include the flow meter.

4. The refrigerator according to claim 3, wherein a distribution ratio of the first water injection amount to the second water injection amount is preset according to the preset ice making amount.

5. The refrigerator according to claim 4, wherein the distribution ratio of the first water injection amount to the second water injection amount includes 1:1 or 2:3.

6. The refrigerator according to claim 3, wherein
that obtaining the first water injection time of the first ice maker includes:
controlling the first ice maker to start a water injection program, and controlling the first ice maker to stop the water injection program until a number of pulses of the flow meter in real time reaches a preset pulse threshold; and
obtaining a time of the first ice maker from a start of the water injection program to a stop of the water injection program, and the time being the first water injection time of the first ice maker.

7. The refrigerator according to claim 3, wherein
that calculating the second water injection time of the second ice maker based on the first water injection amount, the second water injection amount and the first water injection time satisfies the following formula:

$$ticeB=V2\times ticeA/V1;$$

wherein, ticeB is the second water injection time, V1 is the first water injection amount, V2 is the second water injection amount, and ticeA is the first water injection time.

8. The refrigerator according to claim 1, wherein the ice making apparatus further includes:
a water inlet pipe; and
a water valve, an end of the water valve being connected to the water inlet pipe, and another end of the water valve being connected to the plurality of ice makers.

9. The refrigerator according to claim 8, wherein
the ice making apparatus further includes a water outlet pipe, and an end of the water outlet pipe being connected to the another end of the water valve.

10. The refrigerator according to claim 9, wherein the refrigerator further comprises:
a water dispenser connected to another end of the water outlet pipe.

11. The refrigerator according to claim 1, wherein
the refrigerator further comprises an ice storage box to store ice cubes, and the controller is further configured to:
stop an ice making operation of the ice making apparatus when the controller obtains that an amount of ice cubes stored in the ice storage box reaches a preset storage threshold.

12. The refrigerator according to claim 8, wherein the refrigerator body includes a horizontal partition plate disposed at a middle position of the refrigerator body in a height direction, the storage compartment is partitioned into an upper storage compartment and a lower storage compartment by the horizontal partition plate, and the plurality of ice makers satisfies one of the following:
the plurality of ice makers are disposed in the upper storage compartment;
the plurality of ice makers are disposed in the lower storage compartment; or
some of the plurality of ice makers are disposed in the upper storage compartment, and some of the plurality of ice makers are disposed in the lower storage compartment.

13. An ice making method of a refrigerator, the refrigerator comprising an ice making apparatus and a controller, the ice making apparatus including a plurality of ice makers, and the ice making method of the refrigerator comprising:
obtaining an ice making request; and
controlling at least one of the plurality of ice makers to make ice according to the ice making request; wherein
the plurality of ice makers include a first ice maker and a second ice maker, and the ice making request includes:
an ice making request for the first ice maker and the second ice maker to cause the controller to turn on the first ice maker and the second ice maker;
wherein after the first ice maker and the second ice maker are turned on, the ice making method of the refrigerator further comprises:
determining a first water injection amount of the first ice maker and a second water injection amount of the second ice maker according to a preset ice making amount;
obtaining a first water injection time of the first ice maker;
calculating a second water injection time of the second ice maker based on the first water injection amount, the second water injection amount and the first water injection time; and
controlling water injection of the second ice maker according to the second water injection time.

14. The ice making method of the refrigerator according to claim 13, wherein the ice making apparatus further includes a flow meter, and at least one of the plurality of ice makers includes the flow meter.

15. The ice making method of the refrigerator according to claim 14, wherein
obtaining the first water injection time of the first ice maker includes:
controlling the first ice maker to start a water injection program, and controlling the first ice maker to stop the water injection program until a number of pulses of the flow meter in real time reaches a preset pulse threshold; and
obtaining a time of the first ice maker from a start of the water injection program to a stop of the water injection program, and the time being the first water injection time of the first ice maker.

16. The ice making method of the refrigerator according to claim 14, wherein
that calculating the second water injection time of the second ice maker based on the first water injection amount, the second water injection amount and the first water injection time satisfies the following formula:

$$ticeB=V2\times ticeA/V1;$$

wherein, ticeB is the second water injection time, V1 is the first water injection amount, V2 is the second water injection amount, and ticeA is the first water injection time.

17. The ice making method of the refrigerator according to claim 14, wherein a distribution ratio of the first water injection amount to the second water injection amount is preset according to the preset ice making amount.

18. The ice making method of the refrigerator according to claim 17, wherein the distribution ratio of the first water injection amount to the second water injection amount includes 1:1 or 2:3.

* * * * *